US005894884A

United States Patent [19]

Durian et al.

[11] Patent Number: 5,894,884

[45] Date of Patent: Apr. 20, 1999

[54] LIQUID FILLED COOLING FIN WITH REINFORCING RIBS

[75] Inventors: Stewart W. Durian, Waukesha; Stephen Durian, Shawano, both of Wis.

[73] Assignee: Cooper Industries, Inc., Houston, Tex.

[21] Appl. No.: 08/496,141

[22] Filed: Jun. 28, 1995

[51] Int. Cl.[6] ..... H01F 27/12

[52] U.S. Cl. ..... 165/132; 165/177; 165/906; 165/170; 165/104.33

[58] Field of Search ..... 165/130, 170, 165/177, 906, 104.33, 132

[56] References Cited

U.S. PATENT DOCUMENTS

| | | | |
|---|---|---|---|
| 1,816,111 | 7/1931 | De Ferranti et al. | 165/170 X |
| 2,017,201 | 10/1935 | Bossart et al. | 165/177 X |
| 4,209,064 | 6/1980 | Cacalloro et al. | 165/130 |
| 4,413,674 | 11/1983 | Avery et al. | 165/104 |
| 4,556,758 | 12/1985 | Warden | 174/50 |
| 4,745,966 | 5/1988 | Avery | 165/104.33 |

OTHER PUBLICATIONS

Menk Apparatebau GMBH Catalog, dated Jul. 1984.
Menk Corrugated Oil Tank Catalog, undated.
Heinrich Georg GMBH Production Lines for Corrugated Tanks and Casings Catalog, undated.
Metalfab, Inc. Enclosures for Transformers Catalog, undated.

*Primary Examiner*—Allen J. Flanigan
*Attorney, Agent, or Firm*—Conley, Rose & Tayon

[57] ABSTRACT

A liquid filled cooling fin generally comprising two, roughly rectangular, opposing fin walls separated by a relatively thin liquid space or chamber. The opposing walls are sealed at both ends along the depth of the fin and at one of the two edges along the height of the fin. The second, open edge of the fin is attached along the height of the fin in a liquid tight seal to a tank in which a transformer or other heat generating device to be cooled is submerged in a cooling fluid. The tank is provided with holes or other fluid passages so that cooling fluid can circulate between the tank and the fin. Cooling fluid is heated in the tank by the transformer and flows from the tank to the cooling fins, where it is then cooled by transferring heat through the fin walls to ambient air. The cooled cooling fluid then circulates back to the tank, completing a circulation pattern which is continuously repeated in operation.

20 Claims, 2 Drawing Sheets

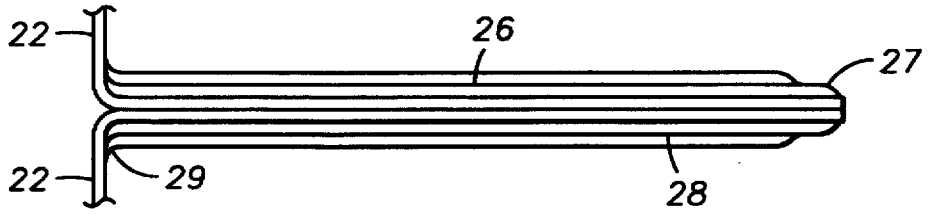
FIG. 2A
FIG. 2B
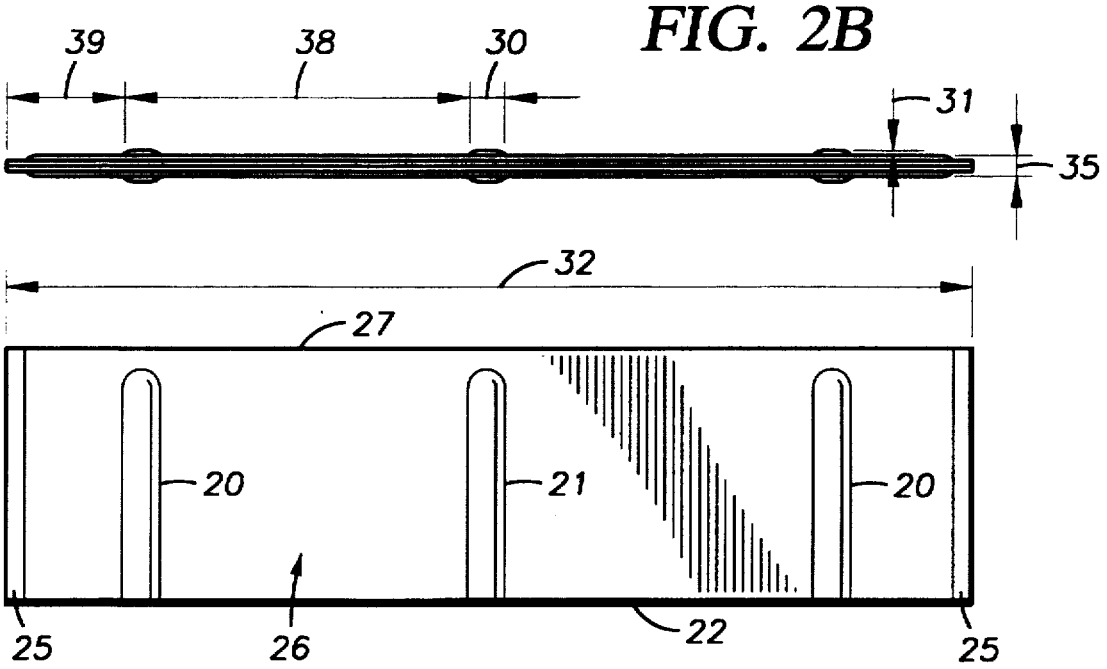
FIG. 2C
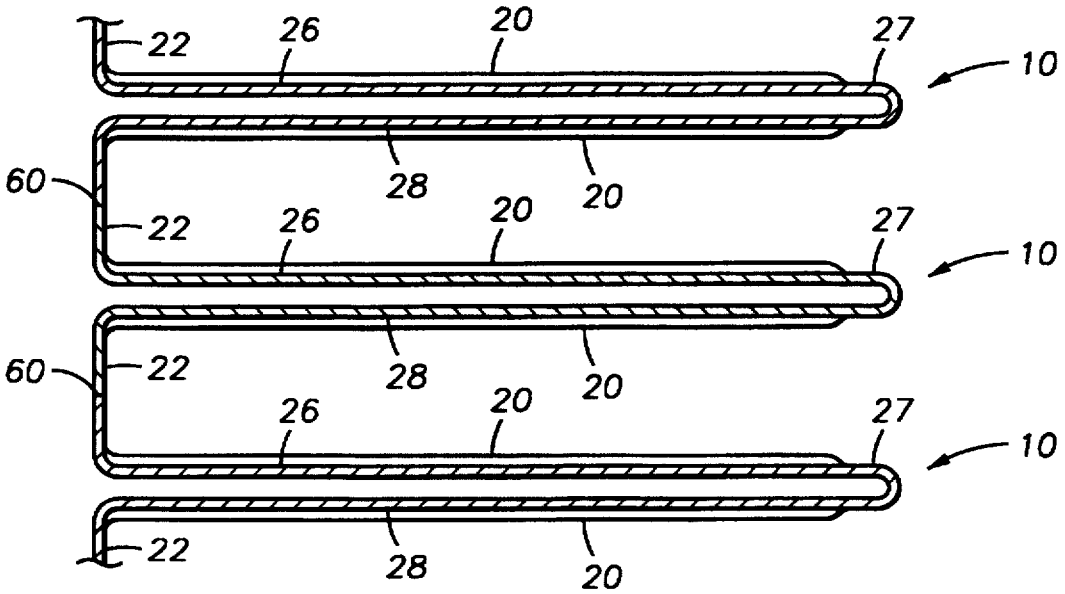
FIG. 3

LIQUID FILLED COOLING FIN WITH REINFORCING RIBS

BACKGROUND OF THE ART

The present invention relates to cooling fins for dissipating heat from cooling fluid used with electrical transformers and other devices and more particularly to a liquid filled cooling fin with reinforcing ribs formed into the fin surfaces to increase the pressure withstand capability of the fin without requiring mechanical attachment of opposing fin walls over the cooling surfaces of the fin.

Electric transformers and other devices, which in the course of normal operation generate potentially harmful heat, are typically located within a tank filled with a cooling fluid in which the transformer is submerged and which transfers heat away from the transformer. To increase the heat dissipation from the tank, it may be provided with additional heat transfer surface, such as a radiator, heat exchanger, or cooling fins for transferring heat from the cooling fluid to ambient air. Cooling fins generally consist of two, roughly rectangular, opposing fin walls separated by a relatively thin liquid space. The walls are sealed together at both ends along the depth of the fin and at one of the two edges (the "nose" of the fin) along the height of the fin. The second, open edge of the fin, generally known as the fin "root" or base, is attached along the height of the fin in a liquid tight seal to the transformer tank. The tank is provided with holes or other fluid passages so that cooling fluid can circulate between the tank and the fin.

The cooling fins are liquid filled and may vary in size and structural configuration depending on the amount of heat produced by the transformer, the ambient temperature, and cooling fluid characteristics. Cooling fluid is heated in the tank by the transformer and flows from the tank to the cooling fins, where it is then cooled by transferring heat through the fin walls to ambient air. The cooled cooling fluid then circulates back to the tank, completing a circulation pattern which is continuously repeated in operation.

As the cooling fluid is heated, its pressure increases. The pressure inside the transformer tank and the cooling fins therefore increases as the cooling fluid temperature increases. It is thus important to transformer operability that the fins be capable of withstanding the cooling fluid pressure. For a given tank size, larger liquid filled fins are used to increase the heat dissipation. A deficiency of prior art fins is that as fin size increases, the cooling fluid pressure at which the fin deforms decreases. For example, It is known from practice and experimentation that plain wall liquid filled cooling fins 54 inches high and 10 inches deep begin to permanently deform at cooling fluid pressures between 7 psig and 10 psig. Thus it has been the case that fins larger than approximately 54 inches high and 10 inches deep cannot be successfully employed because they exhibit unacceptably high deformation at fluid pressures of approximately 7 psig. The pressure withstand capability of liquid filled cooling fins thus limits the maximum height and depth of a fin that can be used on a transformer tank.

A deficiency of prior art attempts to increase fin size and heat dissipation capacity is that such attempts have generally resulted in fins that are more complicated in design and construction in order to withstand the cooling fluid pressure. For example, fins including extensive troughs or dimples typically require a considerable number of spot welds between opposing fin walls, and are consequently more expensive to manufacture than plain wall fins.

The primary mode of fin deformation is by increase in the fin thickness, "ballooning" the opposing walls of the fin outward. The fin experiences two modes of failure from deformation due to pressure loading. The first mode is permanent deformation of the fin walls such that the fin walls do not return to their originally manufactured shape and size after removal of the pressure load. The second mode is catastrophic failure, in which the fin deforms sufficiently to cause excess loading of welded connections and weld failure, typically at the ends of the fin. A liquid filled cooling fin which could be increased in size while maintaining satisfactory pressure withstand capability would therefore be welcomed in the field.

Attempts to overcome the deficiencies of prior art fins have included mechanical fastening of the two opposing fin walls at locations between the fin ends and between the fin nose and root. For example, U.S. Pat. No. 4,413,674 discloses reinforcing the fin panel by spot welding the opposing walls of the fin together in the presence of formed dimples or troughs. This mechanical fastening requires matching indentations in the opposing fin walls that are to be fastened together. Mechanically fastened fins are more costly, more difficult to form and manufacture, and can result in the formation of weak points and leaks in the fin walls. Further, fabricating extensive troughs or dimples in the fin wall can distort the fin, leading to a poor fit to the transformer tank.

The pressure withstand capability of large fins may also be increased by manufacturing fins of heavier gage or higher strength materials. These approaches result in higher material costs as well as higher fabrication costs. The present invention overcomes the deficiencies of the prior art.

SUMMARY OF THE INVENTION

The present invention provides a liquid filled cooling fin, with reinforcing ribs formed into the opposing walls of the fin, to increase the pressure withstand capability of the fin without mechanical fastenings other than the end crimps and welds used to seal the fin into a liquid tight assembly. A plurality of such fins may be formed or joined together to form a fin bank. One or more fin banks are then welded to a tank to be cooled. Holes are cut into the tank wall between the opposing fin walls at points corresponding to the fin locations to allow cooling fluid to circulate between the tank and the fins. Alternatively, fin banks may themselves form the tank wall, which may be welded to a framework to form a liquid tight tank.

The reinforcing ribs provided with the fin of the present invention increase the rigidity of the fin walls. This increased wall rigidity reduces the deformation of the fin wall under higher cooling fluid pressure loads which, in turn, reduces the stresses in the fin wall material. The present invention thus allows the use of larger fins, with greater heat dissipation, in a variety of applications including transformer tank cooling.

Fins in accordance with the present invention exhibit increased pressure withstand capability relative to prior art fins. The invention exhibits less fin wall deformation, less "ballooning" of the opposing fin walls at a given cooling fluid pressure. Further, the inventive fin withstands higher cooling fluid pressures without catastrophic failure of the end crimps. The invention thus allows the use of larger fins, such as fins with height of 60 inches or more and depth of 12 inches or more, for increased heat dissipation but which are capable of withstanding cooling fluid pressures of 7 psig or greater.

Another advantage of the liquid filled cooling fins of the present invention is that the cost of material and manufacturing for such fins is lower than that of fins with improved pressure withstand capability produced by prior art techniques. Excessive manufacturing time and fabrication cost is avoided because the present invention does not require extensive spot welding. Forming the reinforcing ribs into the fin wall surfaces avoids the complications associated with fins with mechanical fastenings between the opposing walls, and also avoids the risk of leakage and catastrophic failure of spot welds between opposing walls.

The increased pressure withstand capability of the liquid filled cooling fin of the present invention is achieved without the need for heavier gage or higher strength fin wall materials, thus avoiding the increased cost associated with these approaches. Additionally, a good fit between the transformer tank and the fins of this invention is easily obtained because the fin wall distortion resulting from the forming of extensive dimples or troughs in the fin walls is avoided.

A further advantage of the present invention is that it improves the heat dissipation capacity of the fin. This is because the reinforcing ribs increase turbulence in the circulating cooling fluid and the ambient air passing across the fins. The increased turbulence thus improves the transfer of heat both from the cooling fluid to the inside surface of the fin wall and from the outside surface of the fin wall to ambient air.

Examples of the more important features of the invention have thus been summarized rather broadly in order that the detailed description thereof that follows may be better understood, and in order that the contributions to the art may be better appreciated. There are, of course, additional features of the invention that will be described hereinafter and which will form the subject of the claims appended thereto. These and various other characteristics and advantages of the present invention will be readily apparent to those skilled in the art upon reading the following detailed description of the preferred embodiments of the invention and by referring to the accompanying drawings.

BRIEF DESCRIPTION OF THE DRAWINGS

For a detailed description of the preferred embodiments of the invention, reference will now be made to the accompanying drawings wherein:

FIGS. 2A–2C are working drawings of a cooling fin with reinforcing ribs in accordance with the present invention with FIG. 2A showing a top view, FIG. 2B showing an end view, and FIG. 2C showing a side view of the fin; and FIG. 3 is a plan view of a plurality of liquid filled cooling fins which in accordance with the present invention form a wall of an associated transformer tank.

DESCRIPTION OF THE PREFERRED EMBODIMENTS

Figure 1:
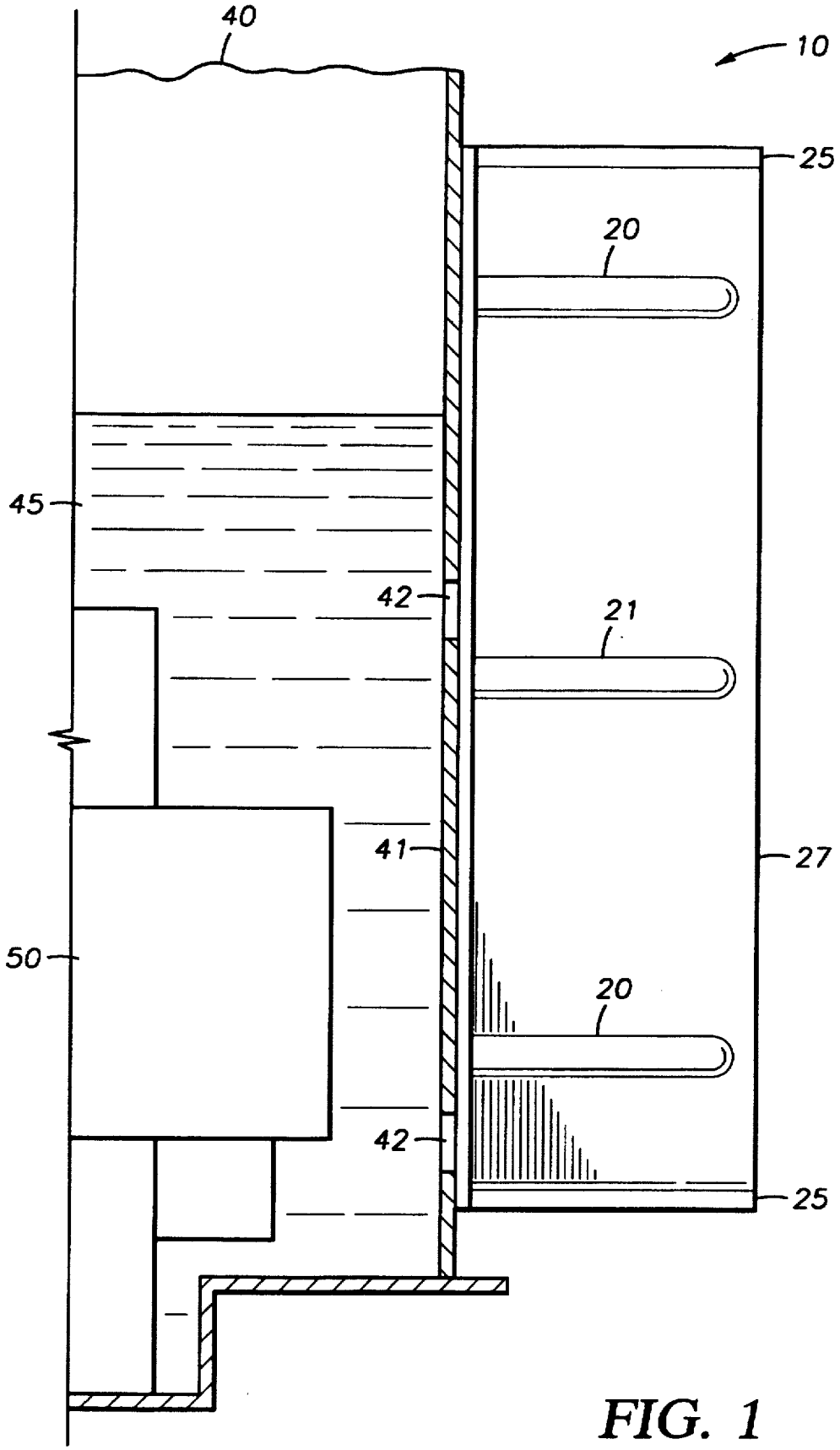
FIG. 1 is an elevational view of a liquid filled cooling fin with reinforcing ribs in accordance with the present invention, with an associated transformer tank portion shown partially in section.

Referring initially to FIG. 1, there is shown a tank 40 containing a cooling fluid 45 in which is submerged a transformer 50. A liquid filled cooling fin 10 in accordance with the present invention is attached to an outer wall 41 of tank 40 by, for example, peripherally welding a base flange 22 of fin 10 to the wall 41 of tank 40 to provide a fluid tight joint. A plurality of holes 42 or other passages (not shown) are provided in the wall 41 of tank 40 for the circulation of cooling fluid 45 between tank 40 and fin 10. Although the present invention will now be described with respect to a plurality of fins 10 disposed on the outer wall 41 of tank 40 and the transformer 50 disposed within tank 40, it should be understood that a single fin 10 is within the scope of the invention. Further, the present invention may be used to dissipate the heat from any heat generating device disposed within tank 40, and tank 40 may be of any of a variety of configurations.

Referring to FIGS. 1 and 2, the cooling fin 10 of the present invention comprises a single sheet of material, preferably sheet steel, formed and bent along nose 27 into two oppositely disposed fin walls 26 and 28. The material is continuous across the nose 27 of fin 10. Fin 10 has fin thickness 35, fin depth 36, and fin height 32. End crimps 25 are made in the two open ends of the material to form end crimps 25 which are welded along the edge of the material to form a liquid tight seal. The material is flared out along the root 29 of the fin 10 to form the base flange 22 of fin 10.

Reinforcing ribs 20 are elongated metal strips that are impressed into the opposing fin walls 26, 28, extending outward from the fin root 29 to the fin nose 27. Reinforcing ribs 20 preferably have a predetermined rib width 30 and a rib height 31 to provide satisfactory support at desired levels of pressure of the cooling fluid 45 to maintain anticipated fin deformations. Likewise, reinforcing ribs 20 are positioned at the same location along the height 32 of both opposing walls 26 and 28, of the fin 10 to maintain predetermined fin deformations at desired levels of pressure of the cooling fluid 45. It is understood that a reinforcing rib centered vertically is not essential to the satisfactory function of the present invention. As will be readily understood by one skilled in the art, any number of reinforcing ribs may be positioned at any locations along the height 32 of both opposing walls 26, 28 such that satisfactory fin deformations at desired cooling fluid pressures are achieved.

In one embodiment of the present invention, a center reinforcing rib 21 is horizontally disposed in fin walls 26 and 28 is centered vertically with an equal number of reinforcing ribs on each side. Reinforcing ribs 20 are then spaced along the height 32 at a distance 38, above and below center reinforcing rib 21. Those ribs 20 adjacent end crimps 25 may have another spacing at a distance 39.

In another embodiment of the invention comprising three reinforcing ribs, fin 10 has a fin height 32 of approximately 60 inches, and a fin depth 36 of 12 inches. In this embodiment, rib width 30 is approximately 1½ inches, and rib height 31 is 0.188 inches. The center rib 21 is vertically centered along the fin height 32. In this embodiment, the rib spacing 38 from center rib 21 is approximately 18¾ inches. Fins constructed in accordance with this embodiment should exhibit acceptable deformation and satisfactory levels of wall stress at cooling fluid pressures of 7 psig or more.

In an alternative embodiment of the invention, where the fin height 32 is 36 inches or less, only one reinforcing rib 20 in fin 10 is necessary to provide satisfactory pressure withstand capability. In another alternative embodiment of the invention, single reinforcing rib 20 may be provided at the center of fin 10 where the fin height 32 is 36 inches or less.

Referring now to FIG. 3, there is illustrated another embodiment of the present invention comprising a bank of fins 10. The plurality of fins 10 is assembled by aligning the fin base flanges 22 of adjacent fins in edge-to-edge abutment. Adjacent base flanges 22 are then secured together in a fluid tight manner, such as by welds 60. The plurality of fins 10 may then be secured to the wall of tank 40 by, for example, peripherally welding the base flanges 22 of fins 10 to the wall of tank 40 to provide a fluid tight joint. Alternatively, the fin base flanges 22 may be overlapped and welded rather than butt welded as illustrated in FIG. 3. In yet another embodiment of the invention, the tank wall may be made of a plurality of fins 10 is assembled as above by welds 60. The resulting assembly of fins is then attached to a framework (not shown) of the tank to comprise the wall of tank 40.

In all of the above embodiments it is understood that any number of walls may be thus provided for tank 40. Similarly, as will be readily understood by one skilled in the art, any number of fins 10 may be provided without departing from the scope of the present invention.

As would be obvious to one skilled in the art, many other applications of the present invention are possible without departing from the spirit of the invention and the description provided herein is intended to be limited only by the claims appended hereto.

We claim:

1. A system for dissipating heat from a fluid whose pressure increases with temperature, comprising:

an enclosure having a wall for containing said fluid; and a plurality of fins circumferentially spaced around said wall, each of said fins comprising:

a pair of substantially parallel, oppositely disposed, sheet-like wall members having facing peripheral edge portions and end portions that are secured together in a fluid tight seal;

said wall members being separated to form a liquid tight cavity;

one of the wall members having a first outturned flange along the edge of the wall member opposite the peripheral edge portion, said flange being connected to said wall of said enclosure;

the other of said wall members having a second outturned flange extending in a direction opposite the first flange; and a reinforcing rib extending radially from said wall of said enclosure, said reinforcing rib impressed into at least one of the wall members and extending from near the peripheral edge portion of said wall member to the edge of the wall member opposite the peripheral edge portion, said reinforcing rib providing reinforcement to said fin to withstand the fluid pressure.

2. The system of claim 1, wherein:

said fin includes at least two reinforcing ribs, wherein said fin includes an absence of mechanical fastening between said reinforcing ribs.

3. The fin of claim 1, wherein said reinforcing rib creates increased turbulence in the circulating cooling fluid and the ambient air passing across said one of the wall members.

4. The fin of claim 2, wherein said pair of reinforcing ribs creates increased turbulence in the circulating cooling fluid and the ambient air passing across said body.

5. The fin of claim 1, wherein said fin has a minimum depth to length ratio of about five to one.

6. The fin of claim 1, wherein said reinforcing rib withstands fluid pressure of at least seven pounds per square inch.

7. A liquid filled cooling fin, comprising:

a pair of substantially parallel, oppositely disposed, sheet-like wall members having facing peripheral edge portions and end portions that are secured together in a fluid tight seal;

said wall members separated by a liquid gap;

one of the wall members having a first outturned flange along the edge of the wall member opposite the peripheral edge portion;

the other wall member having a second outturned flange extending in a direction opposite the first flange.

a first reinforcing rib to add rigidity to said one of the wall members, said first reinforcing rib impressed into said one of the wall members and extending from near the peripheral edge portion of said wall member to the edge of the wall member opposite the peripheral edge portion;

a second reinforcing rib to add rigidity to the other wall member, said second reinforcing rib impressed into the other wall member and extending from near the peripheral edge portion of said other wall member to the edge of said other wall member opposite the peripheral edge portion.

8. A liquid filled cooling fin, comprising:

a pair of substantially parallel, oppositely disposed, sheet-like wall members having facing peripheral edge portions and end portions that are secured together in a fluid tight seal;

said wall members separated by a liquid gap;

one of the wall members having a first outturned flange along the edge of the wall member opposite the peripheral edge portion;

the other wall member having a second outturned flange extending in a direction opposite the first flange; a first reinforcing rib to add rigidity to said one of the wall members, said first reinforcing rib impressed into said one of the wall members and extending from near the peripheral edge portion of said wall member to the edge of the wall member opposite the peripheral edge portion;

a second reinforcing rib to add rigidity to the other wall member, said second reinforcing rib impressed into the other wall member and extending from near the peripheral edge portion of said other wall member to near the outturned flange.

9. The liquid filled cooling fin of claim 7, in which said reinforcing ribs protrude outward from the outer surface of said wall members.

10. The liquid filled cooling fin of claim 9, in which said reinforcing ribs are disposed with a longitudinal axis that is substantially perpendicular to the peripheral edge of said wall members.

11. The liquid filled cooling fin of claim 10, in which said reinforcing ribs are centered on the wall members such that said reinforcing ribs are substantially equidistant along their length from both of the end portions of said wall members.

12. The liquid filled cooling fin of claim 10, further comprising a plurality of reinforcing ribs to add rigidity to the wall members, said reinforcing ribs impressed into the opposing wall members and extending from near the peripheral edge portions of said wall members to near the outturned flanges of the wall members, at least one pair of said plurality of reinforcing ribs generally disposed a predetermined distance from one of the end portions of said wall members.

13. The liquid filled cooling fin of claim 12 wherein the peripheral edge portion is continuous with the wall members.

14. The liquid filled cooling fin of claim 13 wherein the end portions of the wall members are crimped together and welded to form a fluid tight seal.

15. The liquid filled cooling fin of claim 10, wherein the fin has a height substantially equal to the length of the peripheral edge portion and less than 36 inches.

16. The liquid filled cooling fin of claim 11, wherein the fin has a height substantially equal to the length of the peripheral edge portion and less than 36 inches.

17. The liquid filled cooling fin of claim 10, wherein the fin has a height substantially equal to the length of the peripheral edge portion of said wall members and more than 54 inches, and a depth substantially equal to the length of an end portion of said wall members and more than 10 inches.

18. The liquid filled cooling fin of claim 12, wherein the fin has a height substantially equal to the length of the peripheral edge portion of said wall members and more than 54 inches, and a depth substantially equal to the length of an end portion of said wall members and more than 10 inches.

19. The liquid filled cooling fin of claim 17, wherein said ribs have a rib width of approximately one inch or more.

20. The liquid filled cooling fin of claim 19, wherein said ribs have a rib height of approximately three-sixteenths of an inch or more.

* * * * *